US010468183B2

(12) United States Patent
Paeng et al.

(10) Patent No.: US 10,468,183 B2
(45) Date of Patent: Nov. 5, 2019

(54) INDUCTOR AND MANUFACTURING METHOD OF THE SAME

(71) Applicant: SAMSUNG ELECTRO-MECHANICS CO., LTD., Suwon-si, Gyeonggi-do (KR)

(72) Inventors: Se Woong Paeng, Suwon-si (KR); Soo Hyun Lyoo, Suwon-si (KR); Jong Seok Bae, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 222 days.

(21) Appl. No.: 15/276,269

(22) Filed: Sep. 26, 2016

(65) Prior Publication Data

US 2017/0200551 A1 Jul. 13, 2017

(30) Foreign Application Priority Data

Jan. 11, 2016 (KR) ..... 10-2016-0003087

(51) Int. Cl.
*H01F 17/00* (2006.01)
*H01F 41/04* (2006.01)

(52) U.S. Cl.
CPC ..... *H01F 41/041* (2013.01); *H01F 17/0013* (2013.01); *H01F 2017/002* (2013.01)

(58) Field of Classification Search
CPC ..... H01F 5/00; H01F 27/28; H01F 27/2804
USPC ..... 336/200, 232
See application file for complete search history.

(56) References Cited

U.S. PATENT DOCUMENTS 5,243,142 A * 9/1993 Ishikawa ..... H05K 1/113 174/258
5,515,022 A * 5/1996 Tashiro ..... H01F 17/0013 174/262
2006/0081397 A1* 4/2006 Enchi ..... H05K 1/165 174/260
2008/0231402 A1* 9/2008 Jow ..... H01F 17/0013 336/83
2013/0068513 A1* 3/2013 Hirai ..... H05K 3/4069 174/257
2014/0097927 A1* 4/2014 Yamamoto ..... H01F 41/041 336/200
2015/0077209 A1* 3/2015 Fujii ..... H01F 17/0006 336/200

(Continued)

FOREIGN PATENT DOCUMENTS

JP 03116702 A * 5/1991
JP 2001-217550 A 8/2001

(Continued)

OTHER PUBLICATIONS

Notice of Office Action dated Apr. 19, 2017, in corresponding Korean Patent Application No. 10-2016-0003087, with English language translation.

*Primary Examiner* — Tszfung J Chan
(74) *Attorney, Agent, or Firm* — Morgan, Lewis & Bockius LLP

(57) ABSTRACT

An inductor includes a body including a coil, the coil including a plurality of coil patterns connected by a via, is disposed, wherein the via includes a first conductive layer and a second conductive layer, formed on the first conductive layer, and the second conductive layer includes a conductive powder and an organic material.

19 Claims, 7 Drawing Sheets

(56) References Cited

U.S. PATENT DOCUMENTS

2015/0092314 A1* 4/2015 Kim ..... H01F 27/29
361/270

FOREIGN PATENT DOCUMENTS

| | | | | |
|---|---|---|---|---|
| JP | 2007-67427 | A | | 3/2007 |
| JP | 2007067427 | A | * | 3/2007 |
| JP | 2009152347 | A | * | 7/2009 |
| JP | 2012-15291 | A | | 1/2012 |
| JP | 2012015291 | A | * | 1/2012 |
| KR | 10-2010-0127936 | A | | 12/2010 |

* cited by examiner

INDUCTOR AND MANUFACTURING METHOD OF THE SAME

CROSS-REFERENCE TO RELATED APPLICATION

This application claims the benefit of priority to Korean Patent Application No. 10-2016-0003087, filed on Jan. 11, 2016 with the Korean Intellectual Property Office, the entirety of which is incorporated herein by reference.

TECHNICAL FIELD

The present disclosure relates to an inductor and a method of manufacturing the same.

BACKGROUND

Laminated inductors generally have a structure in which a plurality of insulating layers, including conductive patterns, are stacked. Such conductive patterns are commonly sequentially connected by conductive vias formed in the insulating layers and overlapped in a stacking direction, thereby forming a coil having a spiral structure. In addition, both ends of the coil may extend outwards from surfaces of the laminated structure, to be connected to an external terminal.

Inductors are mainly surface mounted devices (SMD) mounted on a circuit board. In particular, high-frequency inductors, used for signals within a high frequency band, equal to or higher than 100 MHz, have recently been increasingly used in the telecommunications market. One important issue related to the use of high-frequency inductors is to ensure sufficient quality-factor (Q-factor) characteristics, representing the efficiency of a chip inductor, therein. Here, the symbol Q, as expressed mathematically, $Q=wL/R$, is a ratio of inductance L to resistance R in a given frequency band.

Since an inductor is manufactured in accordance with a specific nominal inductance value L, resistance R needs to be lowered in order to enhance Q-characteristics at the same inductance value L. In order to lower resistance R, a thickness of a coil pattern may be increased. A coil pattern may be formed using a screen printing method, a method in which limitations exist in increasing the thickness of the coil pattern. In addition, when a relatively thick coil pattern is formed on a ceramic layer, failures such as cracking and delamination may occur during a process of stacking a plurality of sheets including the coil patterns, due to a difference in thickness between a portion of a sheet on which a coil pattern is formed and a portion of a sheet on which a coil pattern is not formed.

Furthermore, vias connecting the coil patterns may be formed by electroplating a metal or by printing a conductive paste (a metal paste). When the vias are formed by the electroplating method, interlayer insulating distances may not be uniform, since hardness of the metal increases during the process of stacking the plurality of sheets. When the vias are formed using the conductive paste, however, Q-characteristics may be degraded, since the resistance of the coil may be increased.

Accordingly, research has been conducted into a structure of an inductor ensuring a uniform insulating distance while also reducing the resistance of the coil.

SUMMARY

An exemplary embodiment in the present disclosure provides an inductor including a via having first and second conductive layers, thereby reducing the resistance of the coil and improving Q-characteristics thereof.

According to an exemplary embodiment in the present disclosure, an inductor includes a body including a coil, the coil including a plurality of coil patterns connected by a via. The via includes a first conductive layer and a second conductive layer formed on the first conductive layer, and the second conductive layer includes a conductive powder and an organic material. Resistance of the coil may be lowered and Q-characteristics may be improved.

According to another exemplary embodiment in the present disclosure, a method of forming an inductor includes forming a coil pattern on a substrate, forming an insulating layer to cover the coil pattern on the substrate, forming a through-hole in the insulating layer, forming a first conductive layer in the through-hole, forming a second conductive layer by printing a conductive paste on the first conductive layer, separating the substrate from the insulating layer including the coil pattern and the first and second conductive layers, and forming a body by stacking a plurality of the separated insulating layers.

BRIEF DESCRIPTION OF THE DRAWINGS

The above and other aspects, features, and advantages will be more clearly understood from the following detailed description, taken in conjunction with the accompanying drawings, in which.

DETAILED DESCRIPTION

Figure 1:
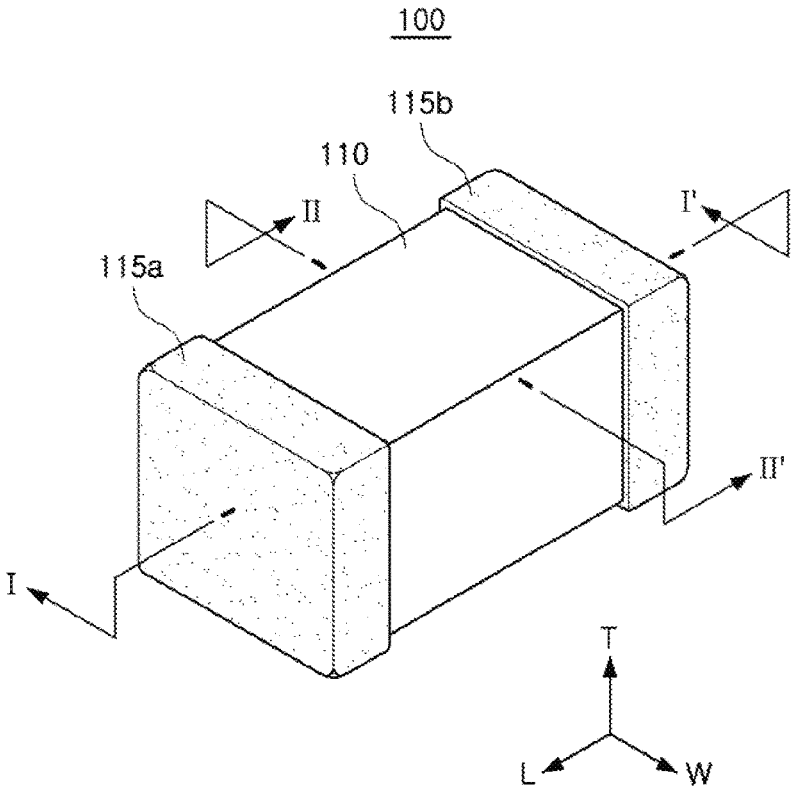
FIG. 1 is a schematic perspective view illustrating an inductor according to an exemplary embodiment in the present disclosure.

Hereinafter, embodiments will be described as follows with reference to the attached drawings. In the drawings, shapes and sizes of components may be exaggerated or minimized for clarity.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to,"

or "directly coupled to" another element, there may be no other elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship relative to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted by one or a combination thereof.

The contents of the present disclosure described below may have a variety of configurations and propose only a required configuration herein, but are not limited thereto.

Hereinafter, an inductor 100 according to an exemplary embodiment in the present disclosure will be described.

Figure 2:
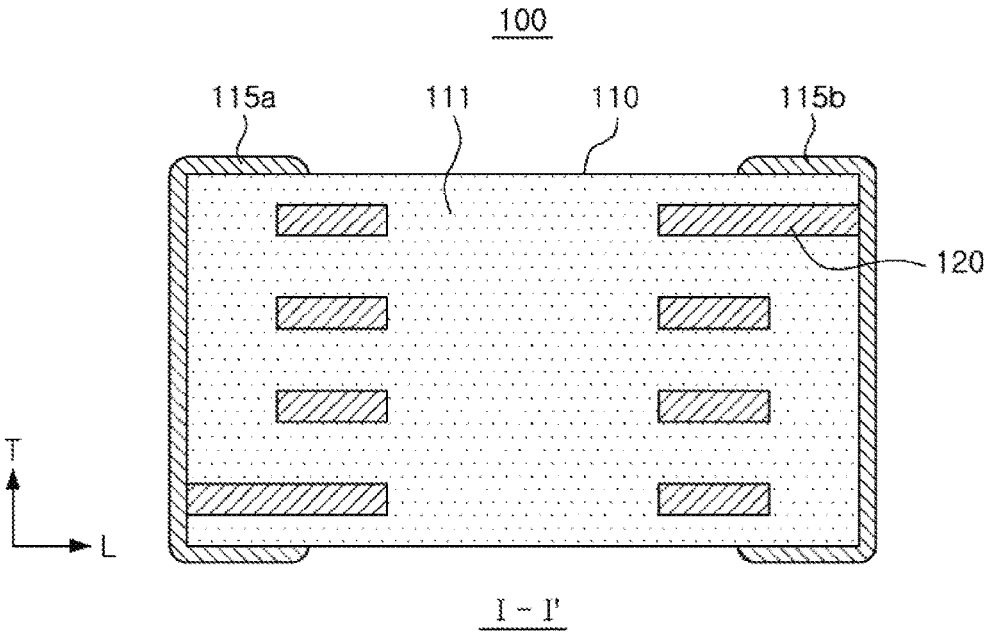
FIG. 2 is a schematic cross-sectional view taken along line I-I' in FIG. 1, that is, a cross-sectional view of an inductor according to an exemplary embodiment in the present disclosure.
Figure 3:
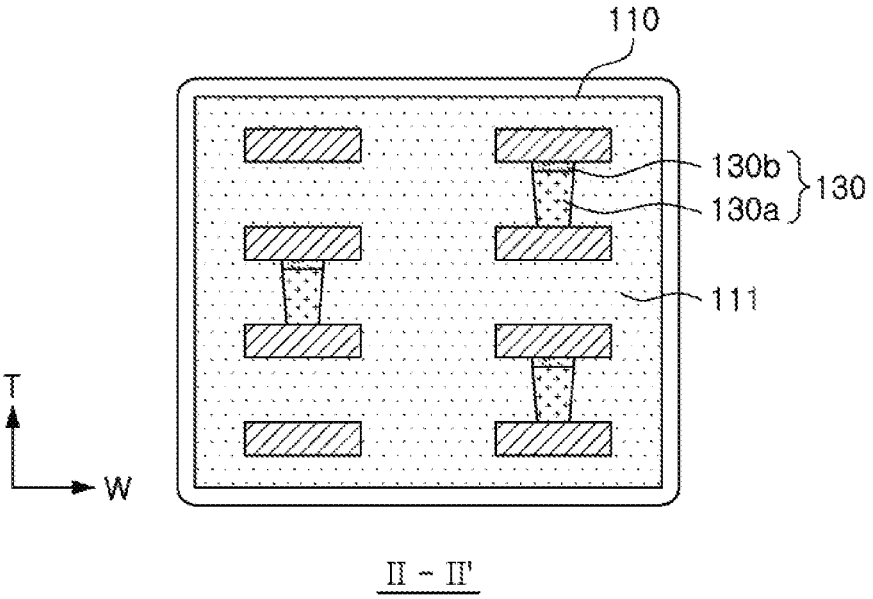
FIG. 3 is a schematic cross-sectional view taken along line II-II' in FIG. 1, that is, a cross-sectional view of an inductor according to an exemplary embodiment in the present disclosure.

FIG. 1 is a schematic perspective view illustrating an inductor according to an exemplary embodiment in the present disclosure. FIG. 2 is a schematic cross-sectional view taken along line I-I' in FIG. 1, that is, a cross-sectional view of an inductor, according to the present exemplary embodiment. FIG. 3 is a schematic cross-sectional view taken along line II-II' in FIG. 1, that is, a cross-sectional view of an inductor, according to the present exemplary embodiment.

Referring to FIGS. 1 to 3, the inductor 100, according to the present exemplary embodiment, may include a body 110 including a coil 120, the coil being formed of a plurality of coil patterns connected through vias 130. Here, the vias 130 may include a first conductive layer 130*a* and a second conductive layer 130*b* formed on the first conductive layer 130*a*. The second conductive layer 130*b* may include a conductive powder and an organic material.

Although not illustrated in the drawings, the body 110 may include a first main surface, a second main surface, and a side surface connecting the first main surface to the second main surface. The side surface may be a surface in a direction perpendicular to a direction in which insulating layers are stacked.

Normally, a body of an inductor is formed by stacking and sintering a plurality of ceramic layers in which coil patterns are formed. In this case, cracking or delamination between the ceramic layers may occur due to a difference in thickness between a portion of a ceramic layer on which the coil pattern is formed and a portion of a ceramic layer on which the coil pattern is not formed.

The body 110 of the inductor 100, according to the present exemplary embodiment, may be formed of an insulating material. Since the body 110 is formed of the insulating material, there is no difference in levels caused by the coil patterns. Accordingly, defects such as cracks may be prevented. In addition, since the inductor 100, according to the present exemplary embodiment, has a low dielectric constant compared to a normal inductor formed of a ceramic material, parasitic capacitance may be reduced, and thereby Q-characteristics of the inductor may be ensured.

The body 110 may be formed by stacking insulating layers 111.

The insulating material may include at least one of a photosensitive material, an epoxy-based material, an acryl-based material, a polyimide-based material, a phenol-based material, and a sulfone-based material.

After the insulating layers 111 are stacked and cured, interfaces between the insulating layers 111 may be blurred and hardly distinguished. A shape and size of the body 110 and the number of stacks of the insulating layers 111 are not specifically limited to those illustrated in the exemplary embodiment of the present disclosure.

The body 110 may include the coil 120.

The coil 120 may include a material containing silver (Ag), copper (Cu), or alloys thereof, but is not limited thereto.

End portions of the coil 120 may extend outwards from both side surfaces of the body 110 and be electrically connected to an external electrode.

The coil 120 may have a spiral structure in which the plurality of coil patterns are sequentially connected through the vias 130 and overlapped in a stacking direction thereof.

The vias 130 may be disposed to be spaced apart from each other, between the insulating layers 111.

Here, a cover layer (not shown) may be formed on at least one of a top surface and a bottom surface of the body 110, in order to protect the coil 120 disposed in the body 110.

The cover layer may be formed by printing a paste formed of the same material as the insulating layers 111 in a predetermined thickness.

Commonly, inductors include vias connecting coil patterns formed by electroplating or by using a conductive paste. When an inductor includes a via formed using the conductive paste, resistance of a coil of the inductor may increase and Q-characteristics of the inductor may be lowered, since the conductive paste has a high volume resistivity. When an inductor includes a via formed by electroplating, however, interlayer insulating distances may not be uniform since the via is formed only of a metal and thus has a high level of hardness.

Referring to FIG. 3, since the via 130 of the inductor 100, according to the present exemplary embodiment, includes the first conductive layer 130*a* and the second conductive layer 130*b* formed on the first conductive layer 130*a*, the second conductive layer 130*b* including a conductive powder and an organic material, the resistance of the via 130 may be lowered, and thus the resistance of the coil may be lowered. Accordingly, Q-characteristics of the inductor 100 may be improved. In addition, since the via 130 partially includes the organic material, insulating distances between the coil patterns may be uniform even when the plurality of insulating layers 111 are stacked.

The first conductive layer 130*a* may be formed of at least one of Ag, Cu, nickel (Ni), and tin (Sn). The first conductive layer 130*a* may be formed of Cu, but is not limited thereto.

The second conductive layer 130*b* may include a conductive powder and an organic material, and the conductive powder may include at least one of Ag, Cu, Sn, bismuth (Bi), and alloys thereof.

The conductive powder may include two or more types of powder particles, having different sizes. For example, the conductive powder may include Sn or Bi, having a diameter of 3 μm, or Ag, having a diameter of 1 μm, but is not limited thereto.

The organic material may include at least one of a polymer and a flux. For example, the organic material may include one selected from an epoxy, acrylate, and a phenolic resin, but is not limited thereto.

The via 130 may have various cross-sectional shapes, such as a tetragonal shape, an inverted trapezoidal shape, or a trapezoidal shape, depending on the manufacturing methods used, thereof. For example, the via 130 may have an inverted trapezoidal shape having an upper surface longer than a lower surface, but is not limited thereto.

External electrodes 115*a* and 115*b* may be disposed on first and second side surfaces of the body 110.

The external electrodes 115*a* and 115*b* may be formed of a material having excellent electrical conductivity. For example, the external electrodes 115*a* and 115*b* may be formed of a conductive material such as Ag, Cu, or alloys thereof, but is not limited thereto.

In addition, an electroplating layer may further be formed by electroplating Ni or Sn on surfaces of the external electrodes 115*a* and 115*b*.

Hereinafter, a method of fabricating an inductor, according to an exemplary embodiment in the present disclosure, will be described in detail.

The method of fabricating the inductor, according to an exemplary embodiment in the present disclosure, may include forming a coil pattern 320 on a substrate 10, forming an insulating layer 111 to cover the coil pattern 320 on the substrate 10, forming a through-hole 135 in the insulating layer 111, forming a first conductive layer 130*a* in the through-hole 135, forming a second conductive layer 130*b* by printing a conductive paste 131 on the first conductive layer 130*a*, separating the substrate 10 from the insulating layer 111 including the coil pattern 320 and the first and second conductive layers 130*a* and 130*b*, and forming a body 110 by stacking a plurality of the insulating layers 111, separated from the substrate 10.

The insulating layer 111 may include at least one of a photosensitive material, an epoxy-based material, an acryl-based material, a polyimide-based material, a phenol-based material, and a sulfone-based material.

When the insulating layer 111 is formed of the photosensitive material, the through-hole 135 may be formed in a photoresist (PR) process, and when the insulating layer 111 is formed of at least one of the group consisting of the epoxy-based material, the acryl-based material, the polyimide-based material, the phenol-based material, and the sulfone-based material, the through-hole 135 may be formed by laser drilling.

The through-hole 135 may have various cross-sectional shapes, such as a tetragonal shape, an inverted trapezoidal shape, or a trapezoidal shape, depending on manufacturing methods thereof. For example, the through-hole 135 may have an inverted trapezoidal shape, but is not limited thereto.

The first conductive layer 130*a* may be formed by plating, and may be formed of a conductive metal. The conductive metal may include at least one of Ag, Cu, Ni, and Sn. The conductive metal may be Cu, but is not limited thereto.

The second conductive layer 130*b* may be formed by printing the conductive paste 131, including a conductive powder and an organic material.

The conductive paste 131 may be either a thermosetting type conductive paste or a low-temperature, sintering type conductive paste, sintered at 230° C. or less.

The conductive paste 131 may include the conductive powder and the organic material.

The conductive powder may include at least one of Ag, Cu, Sn, and Bi, and may include two or more types of powder particles having different sizes. For example, the conductive powder may include Sn or Bi having a diameter of 3 μm and Ag having a diameter of 1 μm, but is not limited thereto.

The organic material may include at least one of a polymer and a flux. For example, the organic material may include one selected from an epoxy, acrylate, and a phenolic resin, but is not limited thereto.

FIGS. 4A to 4G are schematic-process, cross-sectional views provided to illustrate a method of fabricating an inductor according to an exemplary embodiment of the present disclosure. More specifically, FIGS. 4A to 4G illustrate processes of forming a via in detail.

Figure 4A:
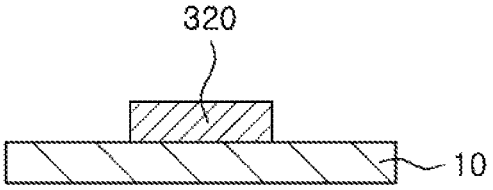
FIGS. 4A to 4G are schematic-process, cross-sectional views provided to illustrate a method of fabricating an inductor according to another exemplary embodiment in the present disclosure.

Referring to FIG. 4A, a coil pattern 320 is formed on a substrate 10.

The substrate 10 may be a copper clad laminate (CCL). The CCL may be a laminate for a printed circuit board (PCB), in which a copper foil is applied on one side or both sides of a base substrate, and the base substrate may be a phenol resin, an epoxy resin, or the like.

The coil pattern 320 may be formed on the CCL by an exposure and development process.

The coil pattern may include Ag, Cu, or alloys thereof. For example, the coil pattern 320 may include Cu, but is not limited thereto.

Figure 4B:
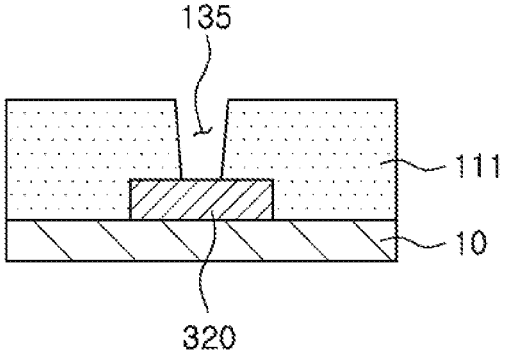

Referring to FIG. 4B, an insulating layer 111 is formed on the substrate 10 to cover the coil pattern 320, and a through-hole 135 may be formed in the insulating layer 111.

The insulating layer 111 may be a photosensitive resin. When the insulating layer 111 is the photosensitive resin, the through-hole 135 may be formed in a PR process.

The through-hole 135 may pass through the insulating layer 111, to be in contact with the coil pattern 320.

When the insulating layer 111 is a negative-type photoresist, a cross-section of the through-hole 135 may have a trapezoidal shape, and when the insulating layer 111 is a positive-type photoresist, the cross-section of the through-hole 135 may have an inverted trapezoidal shape having a top surface longer than a bottom surface.

Figure 4C:
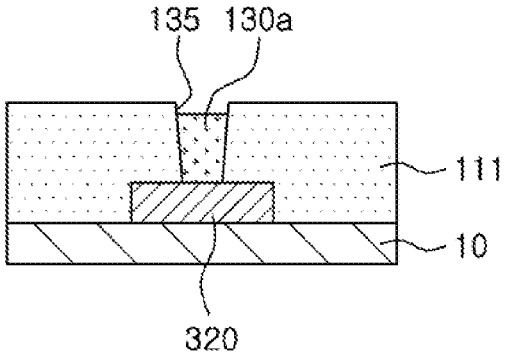

Referring to FIG. 4C, a first conductive layer 130*a* is formed in the through-hole 135.

The first conductive layer 130*a* may be formed of Cu using an electroplating method, but is not limited thereto.

The first conductive layer 130*a* may be formed in a portion of the through-hole 135.

Figure 4D:
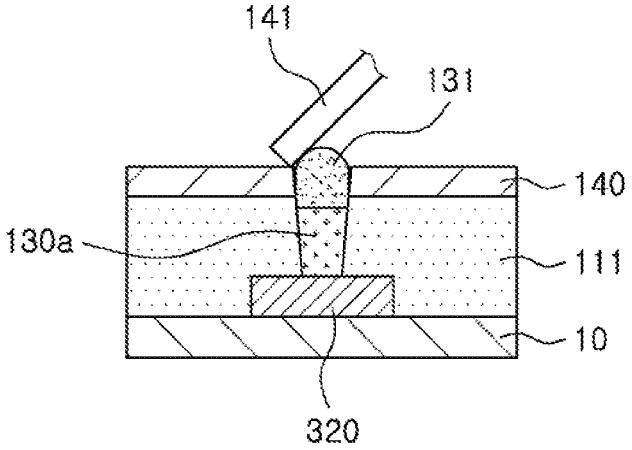

Referring to FIG. 4D, a second conductive layer 130*b* is formed by printing a conductive paste 131 on the first conductive layer 130*a*, to fill the through-hole 135.

A via 130 may include the first and second conductive layers 130*a* and 130*b* formed in the through-hole 135.

The second conductive layer 130*b* may be formed by disposing the conductive paste 131 on a metal mask 140, in which a predetermined pattern is formed, and filling the through-hole 135 with the conductive paste 131, using a squeezer 141.

The second conductive layer 130*b* may include a conductive powder and an organic material.

The conductive powder may include at least one of Ag, Cu, Sn, and Bi, and may include two or more types of powder particles having different sizes.

The organic material may include at least one of a polymer and a flux.

Figure 4E:
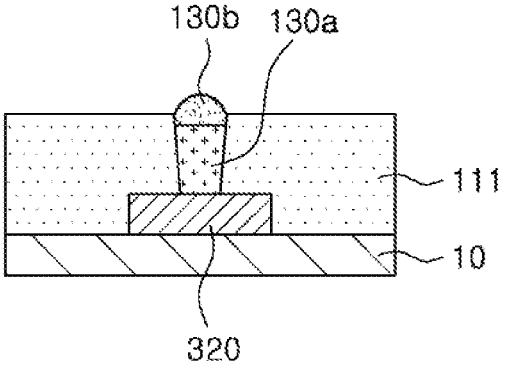

Referring to FIG. 4E, after the printing process, the second conductive layer 130*b* may have a convex portion protruding from a surface of the insulating layer 111.

The convex portion of the second conductive layer 130*b* may be formed to a predetermined height above the surface of the insulating layer 111. The height of the convex portion of the second conductive layer 130*b* may be lowered by 1% to 20% in a subsequent stacking and compressing process, and an internal density of the convex portion may be increased.

The via 130 may include the second conductive layer 130*b* formed of the conductive paste 131. The convex portion of the second conductive layer 130*b* formed of the conductive paste 131 may function as a buffer, dissipating interlayer stress during the stacking and compressing process of a plurality of the insulating layers 111.

Figure 4F:
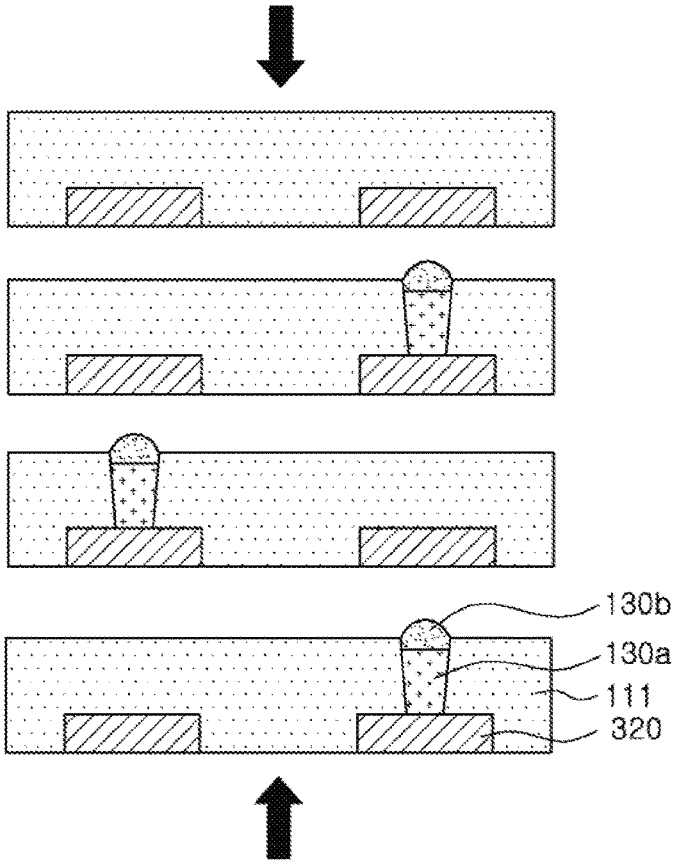
Figure 4G:
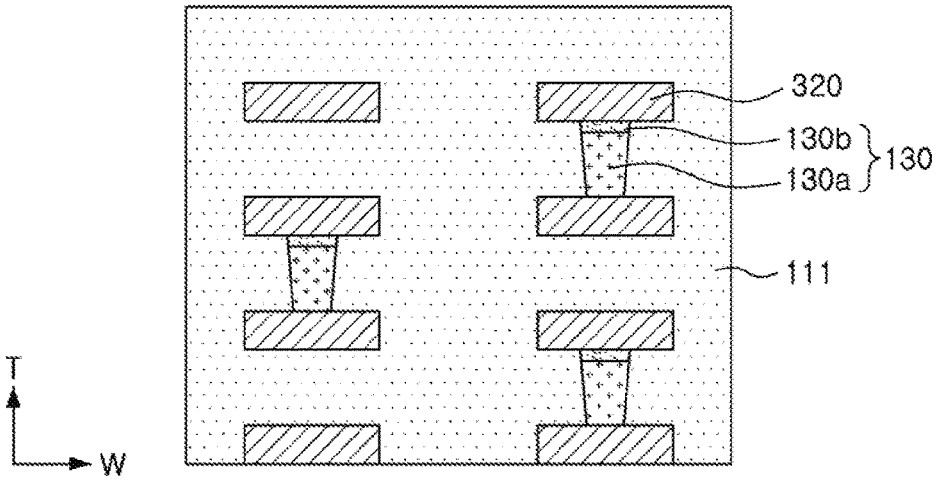

Referring to FIGS. 4F and 4G, the substrate 10 is separated from the insulating layer 111, including the coil pattern 320 and the first and second conductive layers 130*a* and 130*b*, and stacking the plurality of separated insulating layers 111 to form a body.

The substrate 10 may be removed in an etching process.

The plurality of separated insulating layers 111 may be stacked in bulk and compressed at a high temperature to form the body 110.

The formation of the body 110 may not include a sintering process performed at a high temperature, but may be performed at a temperature at which the insulating layers 111 and the second conductive layer 130*b* are cured.

In addition, since the body 110 is formed by stacking the insulating layers 111 in a multilayer, and thermally pressing the stacked insulating layers 111, interlayer insulating distances may be uniform. Accordingly, the resistance of a coil 120 may be lowered, and Q-characteristics of the inductor may be improved.

In general, a sintered metal body is used as a via to connect coil patterns 320 indifferent layers. Since the sintered metal body is a material sintered at a high temperature, in a range from 800° C. to 900° C., an organic material therein may be burnt out during the sintering process. Therefore, the sintered metal body may not include the organic material.

In addition, since the stacking and compressing process is performed before the sintering process, a phenomenon in which the coil pattern 320 and the via 130 are compressed and laterally spread may occur. Accordingly, capacitance of the inductor may be reduced and an interlayer short circuit may occur.

When a curable conductive paste is used to form the via used to connect coil patterns disposed in different levels in a manufacturing process of the inductor, resistance of a coil may be increased, since the curable conductive paste has higher electrical resistance than a sintering-type paste. Accordingly, Q-characteristics of the inductor may be degraded.

In addition, when an electroplating method alone is used to form the via, the via may have a high level of hardness since it is formed only of a metal. Even when a via formed by the electroplating method has a convex portion, interlayer insulating distances may not be uniform, due to the fluidity of the insulating layers, since pressure is weighted to an area, except for the convex portion, during the stacking and compressing process of the insulating layers. In addition, when the convex portion is formed by the electroplating method, it is difficult to form the convex portion to have a uniform size due to variations in electroplating, and interlayer insulating distances may not be uniform, due to differences in height of the convex portion.

The inductor 100, according to the present exemplary embodiment, includes the via 130 including the first and second conductive layers 130*a* and 130*b*. More specifically, the via 130 may include the first conductive layer 130*a*, formed by an electroplating method, and the second conductive layer 130*b*, formed of the conductive paste 131 and including the organic material. Accordingly, electrical resistance of the coil 120 may be lowered, and thereby Q-characteristics of the inductor 100 may be improved.

A plurality of the vias 130 may be disposed to be spaced apart from each other between the insulating layers 111.

The via 130 may connect the coil patterns 320 arranged up and down in parallel to form the coil 120.

End portions of the coil 120 may be exposed on both side surfaces of the body 110, and electrically connected to an external device by external electrodes formed on both side surfaces of the body 110.

The body 110 may be compressed and cured in a process, such as compressing or vacuum-pressing, to maximize a packing rate of the body 110.

When the body 110 is fabricated to have a bar shape, a plurality of bodies 110 may be fabricated by being cut into chip units. Therefore, manufacturing costs of the inductor 100 may be lowered and high productivity may be ensured.

FIGS. 5A to 5G are schematic-process, cross-sectional views provided to illustrate a method of fabricating an inductor, according to another exemplary embodiment in the present disclosure.

Among components illustrated in FIGS. 5A to 5G, descriptions of those having the same configurations as the components illustrated in FIGS. 4A to 4G will be omitted.

Figure 5A:
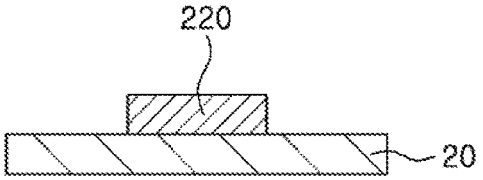
FIGS. 5A to 5G are schematic-process, cross-sectional views provided to illustrate a method of fabricating an inductor according to another exemplary embodiment in the present disclosure.

Referring to FIG. 5A, a coil pattern 220 is formed on a substrate 20.

Figure 5B:
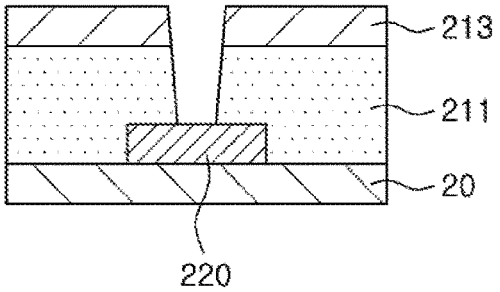

Referring to FIG. 5B, an insulating layer 211 is formed on the substrate 20 to cover the coil pattern 220, and a through-hole is formed in the insulating layer 211.

The insulating layer 211 may be formed of at least one of an epoxy-based material, an acryl-based material, a polyimide-based material, a phenol-based material, and a sulfone-based material.

The insulating layer 211 may be formed together with a carrier film 213 on the substrate 20.

The carrier film 213 has one adhesive surface so as to be attached on the insulating layer 211. The carrier film 213 may be a polyethylene terephthalate (PET), but is not limited thereto.

When the insulating layer 211 is formed of at least one of the epoxy-based material, the acryl-based material, the polyimide-based material, the phenol-based material, and the sulfone-based material, the through-hole may be formed by laser drilling.

The through-hole may pass through the carrier film 213 and the insulating layer 211 to be in contact with the coil pattern 220.

Figure 5C:
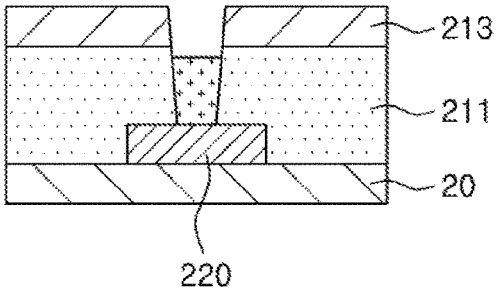

Referring to FIG. 5C, a first conductive layer 230*a* is formed in the through-hole.

The first conductive layer 230*a* may be formed by an electroplating method. The first conductive layer 230*a* may be formed of Cu, but is not limited thereto.

The first conductive layer 230*a* may be formed in a portion of the through-hole.

Figure 5D:
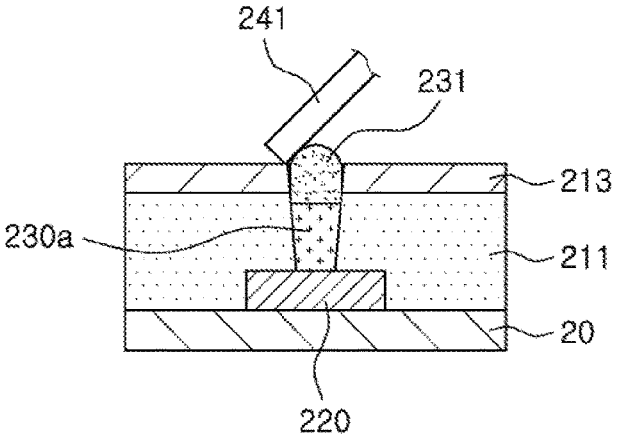

Referring to FIG. 5D, a second conductive layer 230*b* may be formed by printing a conductive paste 231 on the first conductive layer 230*a* to fill the through-hole.

A via 230 may include the first and second conductive layers 230*a* and 230*b* formed in the through-hole.

The second conductive layer 230*b* may be formed by disposing the conductive paste 231 on the carrier film 213 attached on the insulating layer 211 and filling the through-hole with the conductive paste 231, using a squeezer 241.

Next, the carrier film 213 may be removed.

Figure 5E:
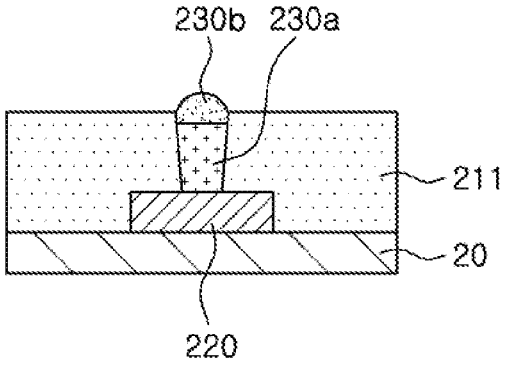

Referring to FIG. 5E, the second conductive layer 230*b* may have a shape protruding convexly from a surface of the insulating layer 211.

A convex portion of the second conductive layer 230*b* may be formed to a predetermined height above the surface of the insulating layer 211. The height of the convex portion of the second conductive layer 230*b* may be lowered by 1% to 20% in a subsequent stacking and compressing process, and thereby an internal density of the convex portion may increase.

The via 230, according to the exemplary embodiment, may include the second conductive layer 230*b* formed of the conductive paste 231. The convex portion of the second conductive layer 230*b* may function as a buffer, dissipating interlayer stresses during the stacking and compressing process of a plurality of the insulating layers 211. Accordingly, a uniform distance between the insulating layers 211 may be maintained.

Figure 5F:
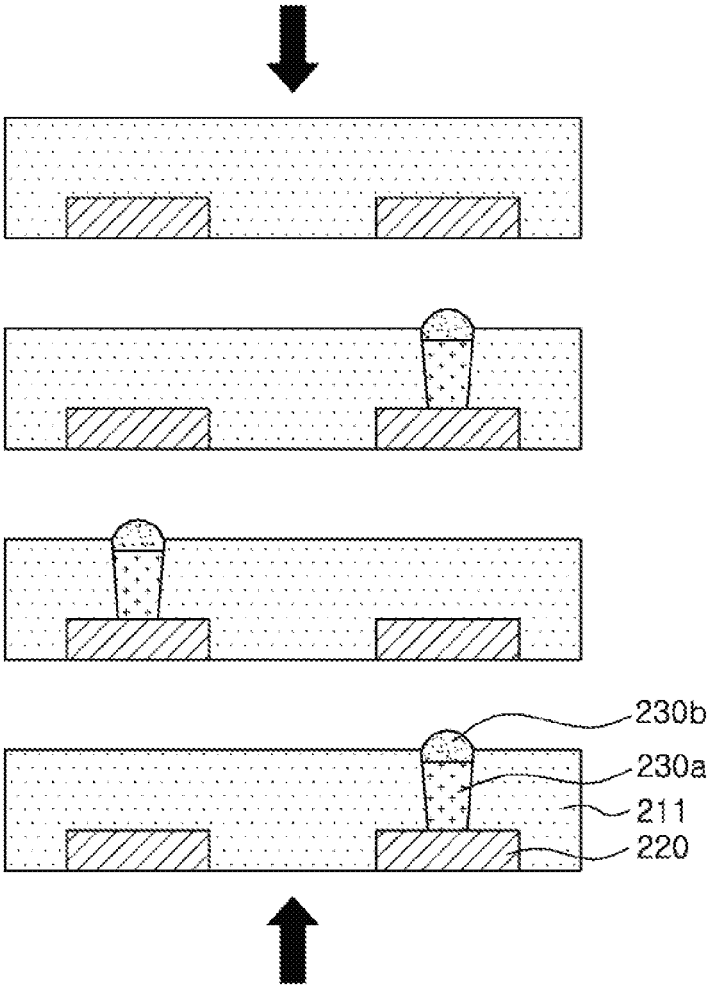
Figure 5G:
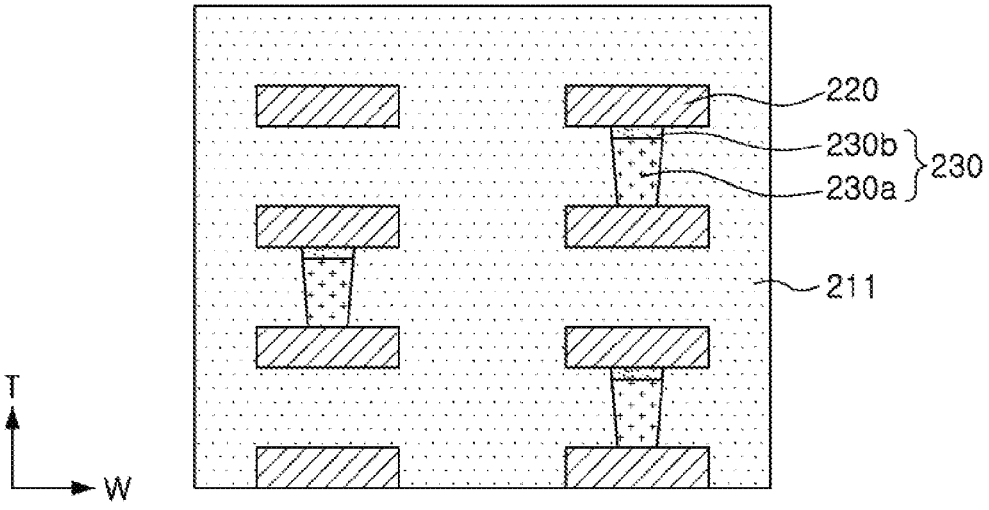

Referring to FIGS. 5F and 5G, the substrate 20 is separated from the insulating layer 211, including the coil pattern 220 and the first and second conductive layers 230*a* and 230*b*, and a plurality of the separated insulating layers 211 are stacked to form a body 210.

The substrate 20 may be removed by an etching process.

The plurality of separated insulating layers 211 may be stacked in bulk and compressed at a high temperature to form the body.

Next, although not shown in the drawings, external electrodes may be formed on both side surfaces of the body 210.

The external electrodes may be formed by dipping the body 210 in a paste for forming an external electrode.

The paste for forming the external electrode may include a conductive powder. The conductive powder may include a material from at least one of Ag or Cu, or alloys thereof, but is not limited thereto.

As set forth above, inductors, according to exemplary embodiments of the present disclosure, may include a coil formed by connecting coil patterns through a via which includes first and second conductive layers. Accordingly, resistance of the coil may be lowered and Q-characteristics of the inductor may be improved.

While exemplary embodiments have been shown and described above, it will be apparent to those skilled in the art that modifications and variations could be made without departing from the scope of the invention, as defined by the appended claims.

What is claimed is:

1. An inductor, comprising:

a body including a coil, the coil including a plurality of coil patterns connected by a via, wherein the via comprises:

a first conductive plating layer disposed in a portion of a through-hole, and a second conductive layer, including a conductive powder and an organic material, disposed in a remaining portion of the through-hole between the first conductive plating layer and a coil pattern of the plurality of coil patterns.

2. The inductor of claim 1, wherein the organic material includes at least one of a polymer and a flux.

3. The inductor of claim 1, wherein the conductive powder includes at least one of silver (Ag), copper (Cu), tin (Sn), and bismuth (Bi).

4. The inductor of claim 1, wherein the conductive powder includes two or more types of powder particles having different sizes.

5. The inductor of claim 1, wherein the body is formed of an insulating material.

6. The inductor of claim 5, wherein the insulating material includes at least one of a photosensitive resin, an epoxy-based material, an acryl-based material, a polyimide-based material, a phenol-based material, and a sulfone-based material.

7. The inductor of claim 1, wherein a cross-section of the via has an inverted trapezoidal shape.

8. The inductor of claim 1, wherein the second conductive layer, including the conductive powder and the organic material and disposed in the remaining portion of the through-hole between the first conductive plating layer and the coil pattern of the plurality of coil patterns, extends through an entire width of the through-hole in the remaining portion of the through-hole.

9. The inductor of claim 1, wherein the plurality of coil patterns are stacked in a stacking direction, and the second conductive layer, including the conductive powder and the organic material, is disposed in the remaining portion of the through-hole between the first conductive plating layer and the coil pattern of the plurality of coil patterns in the stacking direction.

10. A method of forming an inductor, comprising steps of:

forming a coil pattern on a substrate;

forming an insulating layer on the substrate to cover the coil pattern;

forming a through-hole in the insulating layer;

forming a first conductive plating layer in a portion of the through-hole;

forming a second conductive layer by printing a conductive paste including a conductive powder and an organic material on the first conductive layer in a remaining portion of the through-hole;

separating the substrate from the insulating layer including the coil pattern and the first and second conductive layers; and forming a body by stacking a plurality of the separated insulating layers such that the second conductive layer, including the conductive powder and the organic material, is between the first conductive plating layer of one separated insulating layer and a coil pattern of another separated insulating layer.

11. The method of claim 10, wherein the conductive powder includes two or more types of powder particles having different sizes.

12. The method of claim 10, wherein the conductive powder includes at least one of silver (Ag), copper (Cu), tin (Sn), and bismuth (Bi).

13. The method of claim 10, wherein the organic material includes at least one of a polymer and a flux.

14. The method of claim 10, wherein the through-hole has an inverted trapezoidal shape.

15. The method of claim 10, wherein the insulating layer is formed of at least one of a photosensitive resin, an epoxy-based material, an acryl-based material, a polyimide-based material, a phenol-based material, and a sulfone-based material.

16. The method of claim 15, wherein the through-hole is formed by a photoresist method when the insulating layer is formed of the photosensitive resin.

17. The method of claim 15, wherein the through-hole is formed by laser drilling when the insulating layer is formed of at least one of the epoxy-based material, the acryl-based material, the polyimide-based material, the phenol-based material, and the sulfone-based material.

18. The method of claim 10, wherein the step of forming the second conductive layer by printing the conductive paste on the first conductive layer includes forming the second conductive layer to have a convex portion protruding from a surface of the insulating layer.

19. The method of claim 10, wherein the insulating layer is formed together with a carrier film, and the carrier film is removed after the step of forming the second conductive layer by printing the conductive paste on the first conductive layer.

* * * * *